US005711596A

United States Patent [19]

Hoover et al.

[11] Patent Number: 5,711,596

[45] Date of Patent: Jan. 27, 1998

[54] MECHANICAL ELECTRICAL CONNECTOR FOR AN ELECTRIC LAMP

[75] Inventors: John B. Hoover, Canterbury; Daniel D. Devir, South Sutton, both of N.H.

[73] Assignee: Osram Sylvania Inc., Danvers, Mass.

[21] Appl. No.: 520,152

[22] Filed: Aug. 28, 1995

[51] Int. Cl.[6] ..... H01R 33/00

[52] U.S. Cl. ..... 362/226; 439/441; 313/318.01

[58] Field of Search ..... 439/441, 419, 439/617, 835, 861, 918; 313/318.01, 318.05; 362/61, 226, 396

[56] References Cited

U.S. PATENT DOCUMENTS

| | | | |
|---|---|---|---|
| 1,564,761 | 12/1925 | Daiker | 439/835 |
| 2,725,544 | 11/1955 | Strange | 439/441 |
| 4,759,726 | 7/1988 | Naylor et al. | 439/441 |
| 4,871,331 | 10/1989 | Kondo et al. | 439/918 |
| 5,088,011 | 2/1992 | Williams et al. | 362/61 |
| 5,160,281 | 11/1992 | Culver et al. | 439/918 |

FOREIGN PATENT DOCUMENTS

| | | | |
|---|---|---|---|
| 2637967 | 3/1978 | Germany | 439/419 |
| 97378 | 4/1989 | Japan | 439/441 |
| 161681 | 6/1989 | Japan | 439/441 |

*Primary Examiner*—Alan Cariaso
*Attorney, Agent, or Firm*—William E. Meyer

[57] ABSTRACT

A mechanical electrical connector for an electric lamp lead is disclosed. The connector is formed as a single piece from sheet metal and includes an electrical contact against which the lamp lead is pinched by an approximately perpendicularly extending clamp arm. The clamp arm may be further latched to lock the lead hard against the connector. The single piece connector yields an inexpensive, quickly attached, strong, and permanent mechanical support providing a secure electrical connection for an electric lamp lead.

5 Claims, 5 Drawing Sheets

MECHANICAL ELECTRICAL CONNECTOR FOR AN ELECTRIC LAMP

TECHNICAL FIELD

The invention relates to electric lamps and particularly to lead connectors for electric lamps. More particularly the invention is concerned with a mechanical support providing an electrical connection for an electrical lamp.

BACKGROUND ART

A common way of sealing an electric lamp is to squeeze molten envelope glass around the electric leads. This leaves bare wires exposed as the lamp contacts. The problem is then to mechanically support the lamp, and electrically connect to the leads. The lead is frequently strong enough to support the lamp, but movement of the lamp will frequently pull or push the lead, thereby breaking down the lamp seal, moving the lamp focus or having an unreliable affect on the lamp position, or breaking down the electrical contact with the lead. Numerous designs have then been developed to hold the lamp or contact the lead. To be effective these designs have variously required expensive materials, two or more pieces of construction, time consuming assembly, high temperatures, chemical curing or other cumbersome constructions. There is then a need for a lamp lead contact, and lamp support that is inexpensive, permanent, quickly applied, and highly durable.

U.S. Pat. No. 5,088,011 issued on Feb. 11, 1992 to Warren Williams et at for Headlamp Capsule with Formed Seal Lug shows a 9004 type headlamp capsule. A metal lug is staked to the plastic base allowing a lead to be based through the lug in a well. The lead to lug connection is not specified, but is presumed to be a weld. No mechanical clamp is shown.

DISCLOSURE OF THE INVENTION

A mechanical and electrical connector for an electric lamp lead may be formed as a single piece with a contact arm, a clamp base coupled at a substantial angle to the contact arm thereby forming a joint line between the contact arm and the clamp base, and a clamp arm coupled to the clamp base with the clamp arm having a contact point on an end away from the joint with the clamp base. The connector is formed so that the clamp base and the clamp arm are of approximately equal length, and with the contact point positioned close to the contact arm. The connector further has a formed lead hole to receive a lamp lead, so that the lamp lead may be extended through the lead hole and between contact arm and the clamp arm, and securely pinched between the contact arm and the contact point of the clamp arm.

BEST MODE FOR CARRYING OUT THE INVENTION

Figure 1A:
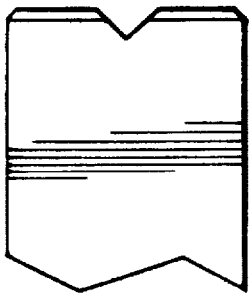
FIG. 1*a* shows an alternative contact edge for a stamped sheet metal form, partially broken away, for a preferred embodiment of the connector.
Figure 1:
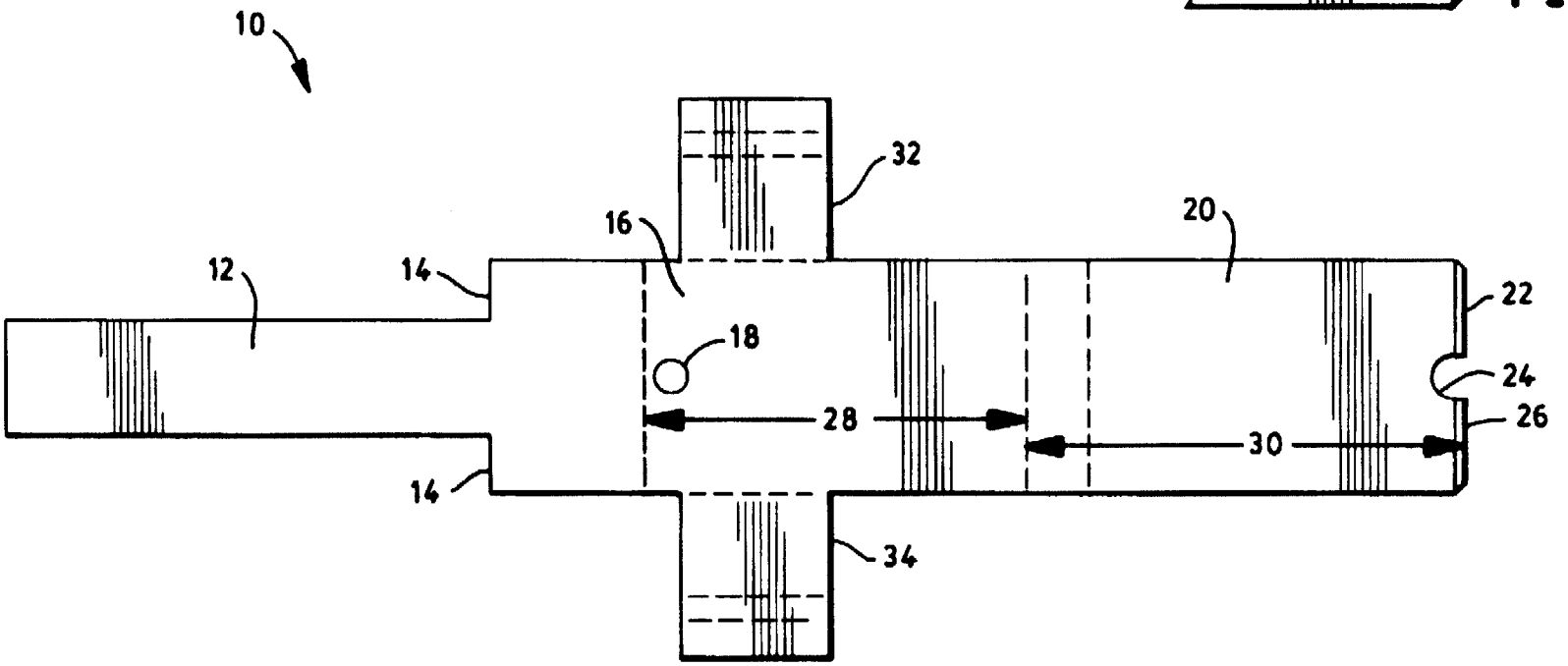
FIG. 1 shows an outline for a stamped sheet metal form for a preferred embodiment of the connector.

FIG. 1 shows a stamping outline for a preferred embodiment of a mechanical electrical connector 10. Fold lines are shown as dashed lines. Like reference numbers designate like or corresponding parts throughout the drawings and specification. The mechanical electrical connector 10 for an electric lamp may be assembled from a single piece of stamped sheet metal.

The mechanical electrical connector 10 may be made from an electrically conductive, deformable material with a substantial spring constant, such as metal, and particularly sheet metal. The connector 10 may be stamped from sheet metal to have the general form of an elongated, flat plate. FIG. 1 outlines a sheet metal stamping form for the preferred connector 10 embodiment. The mechanical electrical connector 10 has an electrical contact arm 12, a lead hole 18, a clamp base 16, a clamp arm 20, and a mating end 22. In the a preferred embodiment one or more lock arms 32, 34 are formed on the connector 10.

The electrical contact arm 12 has any convenient shape useful for making an electrical connection. Push on connectors are commonly used, so in the preferred embodiment the electrical contact arm 12 has the form of a lug. The preferred lug type contact arm 12 is a flat rectangular section of metal, having parallel sides, and a squared end exposed to receive a push on type connector. The lug may be additionally formed with barbs, spring tabs, or similar such features known in the art to be useful in locking or latching a lug to a push on connector. Such additions are considered obvious equivalents with respect to the simple straight lug shown in the drawing. The preferred electrical contact arm 12 also includes one or more stops 14 to help position a connector. In the preferred embodiment, the stops 14 have the form of one or more shelf like protrusions that extend from the parallel sides of the electrical contact arm 12.

Coupled to the contact arm 12 along a fold line is a clamp base 16. The preferred clamp base 16 is an elongated rectangular section of the connector 10. Positioned in the clamp base 16 is a lead hole 18. The lead hole 18 is formed near the joint line between the contact arm 12 and the clamp base 16, and preferable on the clamp base 16 side of the joint line. The lead hole 18 may be a passage formed in the electrical connector 10 with a diameter sufficient to receive a lamp lead. In the preferred embodiment, the lead hole 18 provides a close fit between the electrical connector 10 and a lamp lead 40 to help position and retain the lamp in place.

Positioned away from the contact arm 12, and the joint along the clamp base 16, but coupled to the clamp base 16 is also a clamp arm 20. The clamp arm 20 may be a somewhat resilient extension of the clamp base 16. The clamp base 16 and the clamp arm 20 then form a joint. The clamp arm 20 has a mating end 22 formed on an end distal from the contact arm 12 to contact a lamp lead 40. The mating end 22 may be shaped to be partially conformal with a lamp lead 40. For example the mating end 22 may have a V shaped or semicircular concavity 24 to snugly mate with a circular lead wire. The mating end 22 may have a sharp corner, or even blade like edge 26 to make a cutting, or gouging contact with the lamp lead 40. Given the latching structure described below, a rolled or rounded mating end could be equivalently used, but these are felt to be less secure. The purpose of the mating end 22 is to form a secure contact with the lamp lead 40, for which the Applicants prefer a biting contact. The preferred length 28 of the clamp base 16 from the joint with the contact arm 12 to the joint with the clamp arm 20 is slightly less than the length 30 of the clamp arm 20 from the joint with the clamp base 16 to the mating end 22, plus the diameter of the lead 40.

In the preferred embodiment, extending from the clamp base 16 are a first lock arm 32, and a second lock arm 34. The lock arms 32, 34, in the unfolded, stamped form extend approximately perpendicularly from the line between the lead hole 18 and the mating end 22. The lock arms 32 and 34 may have sufficient length, or may include formed features to latch, lock or trap the clamp arm 20 when the clamp arm 20 is finally positioned. In the preferred embodiment, the lock arms 32, 34 are formed to include right angle bends forming latching ribs 36, 38 to lock the clamp arm 20 in final position.

Figure 2:
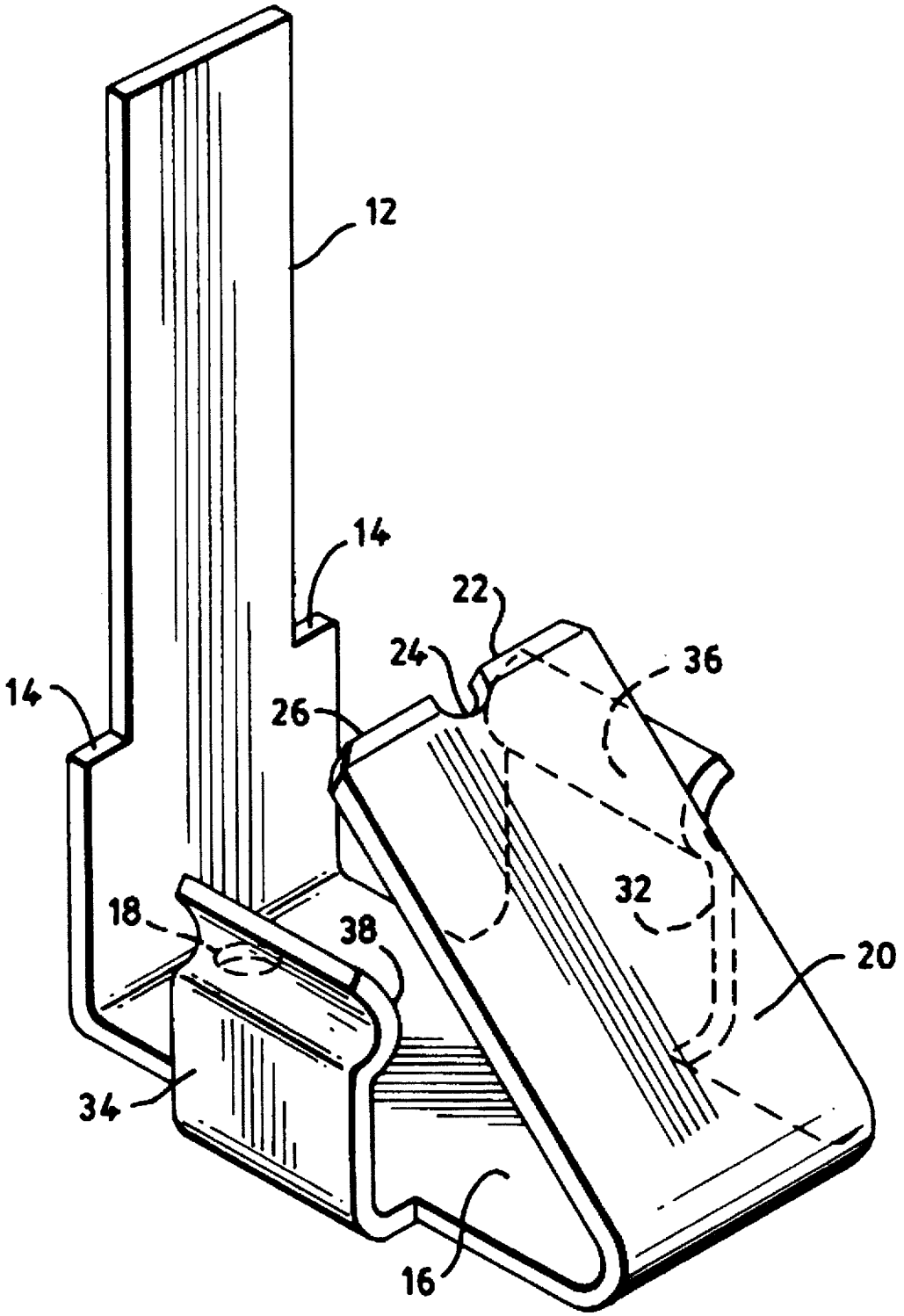
FIG. 2 shows a perspective view of a mechanical electrical connector for a lamp lead prior to coupling with a lamp lead.

The electrical connector 10 may be assembled by first bending the electrical contact arm 12 to form a substantial angle with respect to the clamp base 16. The preferred angle is about 90 degrees. When assembled, the electrical contact arm 12 then forms a wall at one end of the clamp base 16 extending roughly vertical to the clamp base 16. Similarly the clamp arm 20 is bent back over the clamp base 16 to extend the mating end 22 to nearly or actually touch the contact arm 12 at a point somewhat offset from the clamp base 16 in the region of the lead hole 18. The clamp base 16 is therefore bent with respect to the clamp arm 20 to bring the mating end 22 close to the contact arm 12 in the area of the formed lead hole 18. The locking arms 32, 34 if any, are similarly bent up to bring them within convenient latching reach with respect to the clamp arm 20. The latching features, such as latching ribs 36, 38 are also formed as necessary. FIG. 2 shows a perspective view of a mechanical electrical connector 10 prior to being finally closed on a lamp lead 40.

The electrical connector 10 may be operated by inserting a lamp lead 40 thought the formed lamp lead hole 18 to extend approximately parallel to and adjacent with the contact arm 12. The clamp arm 20 is then compressed in the direction of the clamp base 16, thereby capturing between the contact arm 12 and the mating end 22, the lamp lead 40. With further compression of the clamp arm 20, the lamp lead 40 is securely pinched between the contact arm 12 and the mating end 22. The clamp arm 20 may bow in its middle away from the clamp base 16 as the mating end 22 end is pressed closer to the clamp base 16 in the region of the lead hole 18, thereby causing an enduring spring pressure between the contact arm 12 and the clamp arm 20 with lead 40 pressed between. The mating edge 26 may additionally slightly cut into the lead 40, thereby forming a secure mechanical and electrical contact between the connector 10 and the lead 40. In a primitive form, the clamp arm 20 is then held in place by the bent joint between the clamp base 16 and the clamp arm 20 at one end, and the pinching pressure between the electrical contact arm 12 and the clamp arm 20 at the other end.

Figure 3:
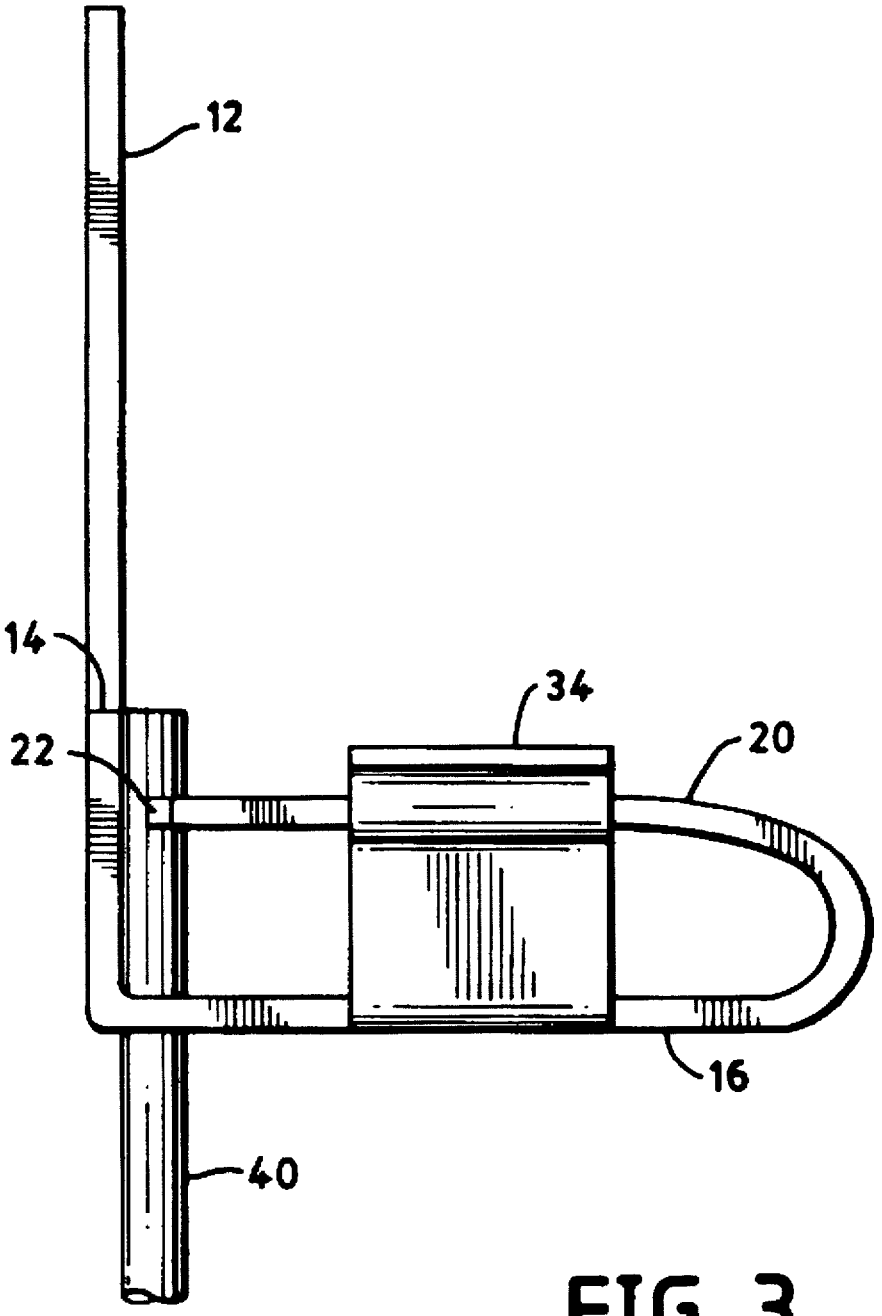
FIG. 3 shows a side view of a preferred embodiment of a mechanical electrical connector coupled to a lamp lead of an electric lamp.
Figure 4:
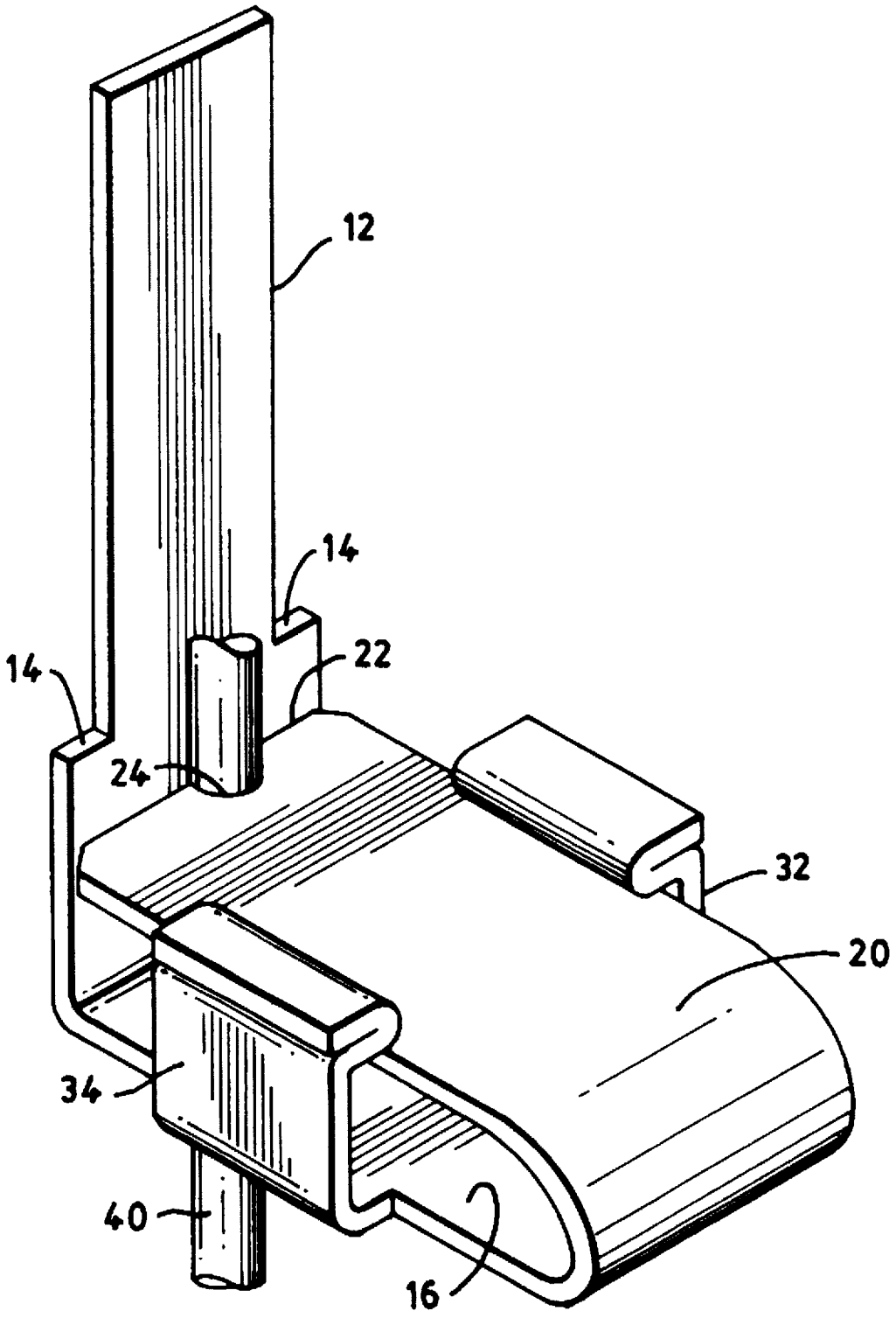
FIG. 4 shows a perspective view of a preferred embodiment of a mechanical electrical connector coupled to a lamp lead of an electric lamp.

In the preferred embodiment, the locking arms 32, 34 are then bent up from the clamp base 16 and over the clamp arm 20 to thereby latch the clamp arm 20 in place with the latching ribs 36 and 38. A toothed, tabbed, or similar locking arrangement may be used to equivalently capture or pinch between the electrical contact arm 12, and the clamp arm 20, the lamp lead 40. The lamp lead 40 is then locked in place, resisting lateral movement by the snug positioning in the lead hole 18, and resisting axial motion by the clamp formed by the electrical contact arm 12, and the clamp arm 20. Once in the closed position, the clamp base 16, clamp arm 20 and the locking arms 32, and 34 may be treated as a unit and securely joined to a lamp housing, or other support structure. A push connector may then be joined to the connector arm 12 to electrically connect to the lamp lead 40. FIG. 3 shows a side view and FIG. 4 shows a perspective view of a preferred embodiment of a mechanical electrical connector in the closed position, coupled to a lamp lead of an electric lamp.

Figure 5:
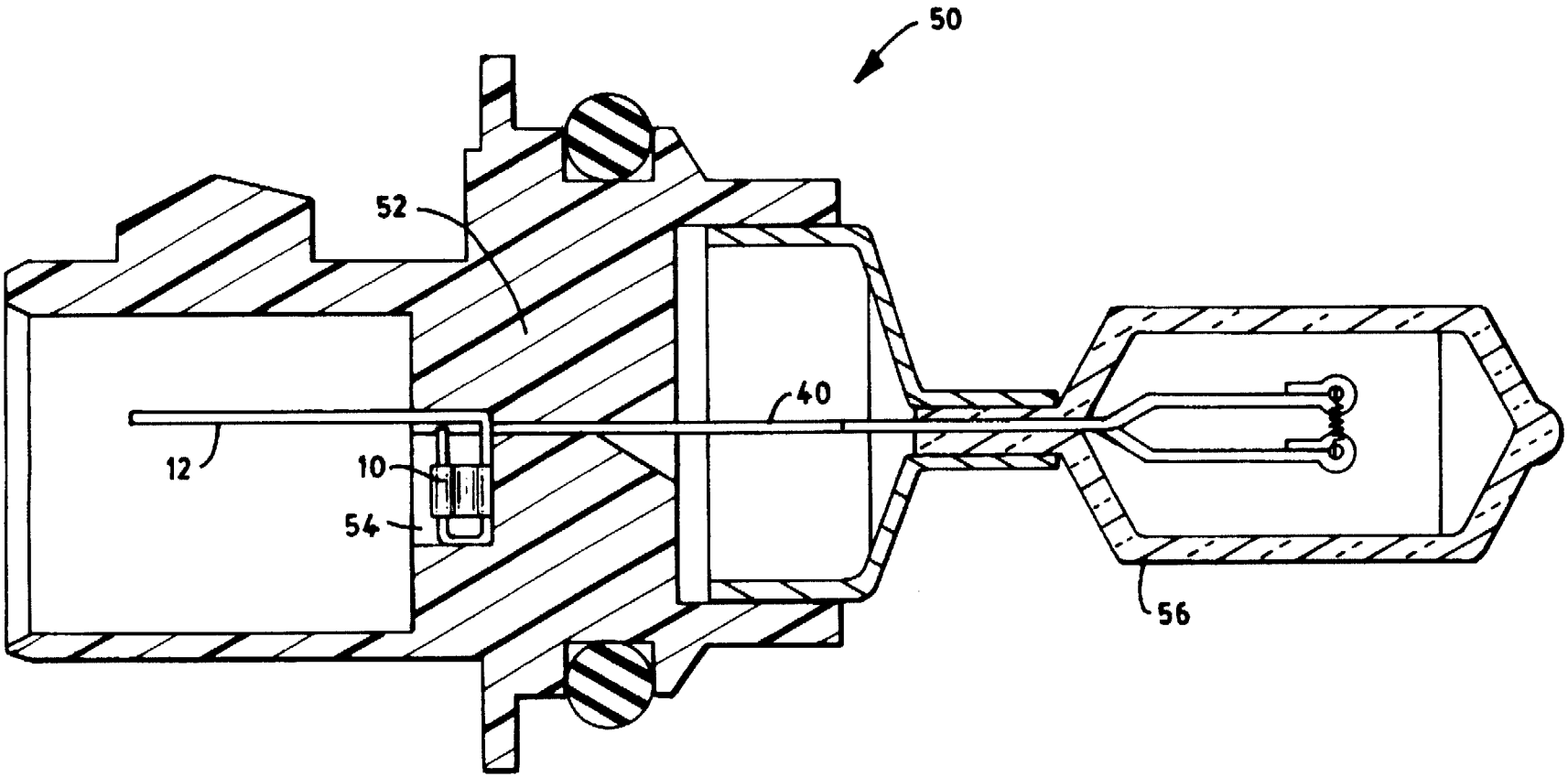
FIG. 5 shows a side view of a plastic headlamp capsule in cross section with a preferred embodiment of a mechanical electrical connector coupled to a lamp lead.

FIG. 5 shows a side view of a plastic headlamp capsule 50 in cross section with a preferred embodiment of a mechanical electrical connector 10 coupled to a lamp lead 40. A lamp lead 40 is threaded through a lead passage formed in a capsule wall 52. The connector 10 is threaded onto the lead 40 from the opposite side, and slid snugly against the wall 52. In the preferred embodiment, formed in the wall 52 is a well 54 to snugly contain the connector 10. When the connector 10, lead 40 and capsule wall 52 are properly positioned, and the lamp 56 is properly aligned, the locking arms 32, 34 are pressed against the clamp arm 20 to lock the lead 40 in place. When the connector 10 is pressed in this fashion, a bulging like expansion occurs in the connector 10 along folds at the clamp arm and locking arm joints. The bulging joint regions then press outward into the adjacent walls of the well 54, further locking the connector 10 to the capsule 50. The connector 10 and the adjacent capsule wall 52, or well 54 may additionally be coated or filled with a sealant, such as a silicon seal as known in the art (not shown).

In one preferred embodiment, the connector was stamped from 0.635 millimeters (0.025 inch) thick tin plated brass. The lead contact was approximately 23.64 millimeters (0.931 inch) long, and 2.99 millimeters (0.118 inch) wide at the end, and 5.58 millimeters (0.220 inch) at the stop. The lead hole was 1.01 millimeters (0.04 inch) in diameter. The clamp base was about 6.85 millimeters (0.27 inch) long, and 5.58 millimeters (0.22 inch) wide. The clamp arm was about 6.35 millimeters (0.25 inch) long and 5.58 millimeters (0.22 inch) wide. A semicircular cut was formed in the middle of the contact edge having a diameter of 1.01 millimeters (0.04 inch) in diameter. The preferred edge is cut with a V from 1.01 millimeters (0.04 inch) across, and from 1.01 millimeters (0.04 inch) deep. The lock arms were about from 2.99 millimeters (0.118 inch) long. The connector was snugly positioned in a hole in the plastic base wall of a 9004 headlamp capsule. The lamp lead was threaded through a hole in the base wall, through lead hole in the clamp. The clamp arm, and lock arms were compressed, pressing the clamp arm perpendicularly into the lead, and simultaneously latching the lock arms over the clamp arm. By the action of closing the connector on the lead, the clamp was simultaneously spread at its ends and sides slightly sufficiently to lock the clamp to the adjacent walls of the plastic base. A standard plug connector could then be attached to the connector arm (lug lead). The lamp was then securely positioned without changing its focal position, and secure, permanent electrical contact was attached to the lead. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A mechanical and electrical connector for an electric lamp lead with a diameter comprising:

a contact arm, a clamp base coupled at a substantial angle to the contact arm thereby forming a joint line between the contact arm and the clamp base, and a clamp arm coupled to the clamp base with the clamp arm having a contact point on an end away from the joint with the clamp base, the clamp base and the clamp arm having lengths differing by not more than the lead diameter, with the contact point being positioned close to the contact arm, the clamp base further having a formed lead hole to receive a lamp lead, so that the lamp lead may be extended through the lead hole and between contact arm and the clamp arm, and securely pinched between the contact arm and the contact point of the clamp arm.

2. A mechanical and electrical connector for an electric lamp lead comprising:

a contact arm, a clamp base coupled at a substantial angle to the contact arm thereby forming a joint line between the contact arm and the clamp base, and a clamp arm coupled to the clamp base with the clamp arm having a contact point on an end away from the joint with the clamp base, the clamp base and the clamp arm being of approximately equal length, with the contact point being positioned close to the contact arm, the clamp base further having a formed lead hole to receive a lamp lead, so that the lamp lead may be extended through the lead hole and between contact arm and the clamp arm, and securely pinched between the contact arm and the contact point of the clamp arm, and the mechanical electrical connector includes a clamp arm lock extending from the clamp base to limit motion of the clamp arm from moving in a direction away from the clamp base.

3. A mechanical and electrical connector for an electric lamp lead comprising:

a contact arm, a clamp base coupled at a substantial angle to the contact arm thereby forming a joint line between the contact arm and the clamp base, and a clamp arm coupled to the clamp base with the clamp arm having a contact point on an end away from the joint with the clamp base, the clamp base and the clamp arm being of approximately equal length, with the contact point being positioned close to the contact arm, the clamp base further having a formed lead hole to receive a lamp lead, so that the lamp lead may be extended through the lead hole and between contact arm and the clamp arm, and securely pinched between the contact arm and the contact point of the clamp arm, and the clamp base is coupled to at least one latch arm, and the latch arm is positioned to hold the clamp arm close to the clamp base and thereby hold the contact edge close to the contact arm.

4. A mechanical and electrical connector for an electric lamp lead comprising:

a contact arm, a clamp base coupled at a substantial angle to the contact arm thereby forming a joint line between the contact arm and the clamp base, and a clamp arm coupled to the clamp base with the clamp arm having a contact point on an end away from the joint with the clamp base, the clamp base and the clamp arm being of approximately equal length, with the contact point being position close to the contact arm, the clamp base further having a formed lead hole to receive a lamp lead, so that the lamp lead may be extended through the lead hole and between contact arm and the clamp arm, and securely pinched between the contact arm and the contact point of the clamp arm, and the clamp base includes a tab bent up from the clamp base, and bent over at least a portion of the clamp arm.

5. A vehicle headlamp capsule comprising:

a lamp capsule having a lead;

a capsule support holding the lamp capsule, being formed with a wall having a through passage, the lead extending through the passage;

a mechanical and electrical connector for an electric lamp lead having a contact arm, a clamp base coupled at a substantial angle to the contact arm thereby forming a joint line between the contact arm and the clamp base, and a clamp arm coupled to the clamp base with the clamp arm having a contact point on an end away from the joint with the clamp base, the clamp base and the clamp arm being of approximately equal length, with the contact point being positioned close to the contact arm, the connector further having a formed lead hole to receive the lamp lead, so that the lamp lead may be extended through the lead hole and between contact arm and the clamp arm, and securely pinched between the contact arm and the contact point of the clamp arm;

the connector being threaded over the lead and positioned adjacent the wall on the side opposite from the side nearest the lamp capsule; and the connector being clamped to the lead while pressing against the adjacent wall, the contact arm thereby forming a lug connector for the lamp capsule.

* * * * *